United States Patent [19]

Garbosch

[11] Patent Number: 4,928,963

[45] Date of Patent: May 29, 1990

[54] RACKET, PARTICULARLY A TENNIS OR SQUASH RACKET

[76] Inventor: Reinhold Garbosch, Obertorstr. 1, D-7778 Markdorf 1, Fed. Rep. of Germany

[21] Appl. No.: 243,024

[22] PCT Filed: Oct. 21, 1987

[86] PCT No.: PCT/DE87/00474

§ 371 Date: Aug. 23, 1988

§ 102(e) Date: Aug. 23, 1988

[87] PCT Pub. No.: WO88/03040

PCT Pub. Date: May 5, 1988

[30] Foreign Application Priority Data

Oct. 25, 1986 [DE] Fed. Rep. of Germany ..... 3636470

[51] Int. Cl.[5] ..... A63B 51/00; A63B 51/14

[52] U.S. Cl. ..... 273/73 D; 273/73 C; 273/73 A

[58] Field of Search ..... 273/73 R, 73 A, 73 B, 273/73 C, 73 D, 73 E, 73 L

[56] References Cited

U.S. PATENT DOCUMENTS

| | | | |
|---|---|---|---|
| 3,994,495 | 11/1976 | Stoffel | 273/73 R X |
| 4,140,316 | 2/1979 | Coupar | 273/73 A |
| 4,484,742 | 11/1984 | McCrone et al. | 273/73 A |
| 4,593,905 | 6/1986 | Abel | 273/73 A X |
| 4,738,449 | 4/1988 | Droz | 273/73 R X |

FOREIGN PATENT DOCUMENTS

| | | | |
|---|---|---|---|
| 133165 | 2/1985 | European Pat. Off. | 273/73 A |
| 2009760 | 9/1971 | Fed. Rep. of Germany . | |
| 855446 | 5/1940 | France . | |

*Primary Examiner*—Edward M. Coven
*Assistant Examiner*—William E. Stoll
*Attorney, Agent, or Firm*—Staas & Halsey

[57] ABSTRACT

A racket for tennis or squash has a frame extending around a generally planar head area and a plurality of holes are provided therein so as to extend in the plane of the area and open into the latter. A plurality of strings are arranged in the area and connectors are provided for securing the ends of the strings in respective corresponding holes. The connector structure includes a string connector assemblage for each end of each string. Each string connector assemblage includes a coupling element rigidly secured to each end of a string and each coupling element includes a shoulder surface facing away from the end where the coupling element is secured and toward the other end of the string. Each connector assemblage also includes a locating element in the corresponding hole and having an abutment surface facing away from the area. The string and the coupling element are adapted to be pushed into the corresponding hole together so that the surfaces become engaged to hold the coupling element and the string in a predetermined string tensioning position relative to the racket frame.

11 Claims, 4 Drawing Sheets

RACKET, PARTICULARLY A TENNIS OR SQUASH RACKET

The invention relates to a racket, particularly a tennis or squash racket, having a network made up of strings of gut or plastic in the racket head.

Rackets of known construction that have lost the necessary tension as a result of intensive stress under tension when in use, or of long storage, must be retensioned. This requires special tensioning devices which are available only in an appropriately equipped workshop. The player who is forced to leave his racket in a workshop will often have to do without his racket for several days. Prior art rackets are strung in such a way that each string is pulled through a large number of holes bored in the frame of the racket head, then tensioned and tied at the ends. If a string breaks, the entire tensioning process must be repeated. The stringing process known in the art is time-consuming and dependent on the tensioning device. The tensioning is inexact, because when the strings are pulled around in the holes, they lose an undefined part of their initial tension.

The invention relates to a racket, particularly a tennis or squash racket, having a network made up of strings of gut or plastic in the racket head, which can be strung and then tensioned by the player himself, without using a tensioning device, and whose strings—viewed over the surface of the web—can be tensioned individually.

According to the invention, this object is achieved through the provision of a racket assembly including a frame extending around a generally planar head area and having a plurality of holes therein extending in the plane of the area and opening into the latter, a plurality of strings arranged in said area, and connector structure for securing the ends of the strings in respective corresponding holes. The connector structure includes a string connector assemblage that comprises a coupling element rigidly secured to an end of the string and including a shoulder surface facing away from said end and toward the other end of the string, and a locating element in the corresponding hole for said end of the string and having an abutment surface facing away from said area. The string and coupling element are adapted to be pushed into the corresponding hole together so that said surfaces become engaged to hold the coupling element and the string in a predetermined string tensioning position relative to the racket frame.

Unlike prior art rackets, the invention has the advantage that the player can string his racket himself without using a known tensioning device. Where a string has lost its tension, has been broken, or for other reasons needs replacement, the player can replace it himself and in the process take account of the desired initial tension, quality, and color, that is to say, he can adapt the strings individually to his personal requirements.

Other modifications of the invention can be seen from the claims and the ensuing description.

The invention will now be described with reference to embodiments in conjunction with the accompanying drawings, in which.

Figure 1:
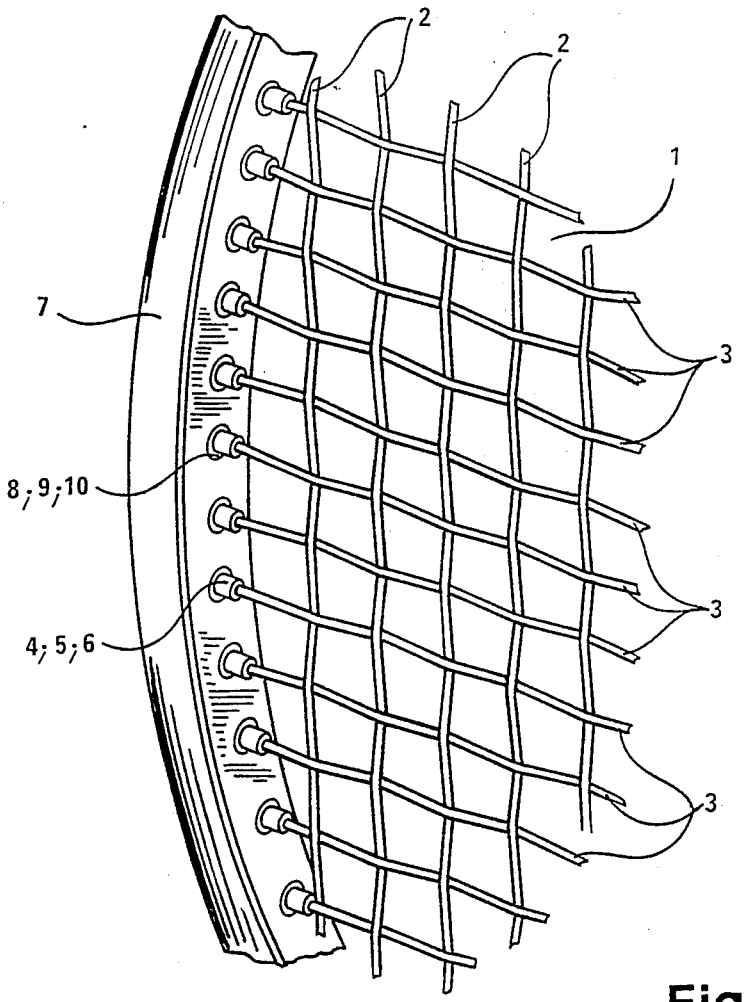
FIG. 1 is a partial perspective view of a racket.

The head of a racket includes a frame 7 (FIG. 1) made of wood or plastic, a network 1 made up of a plurality of strings 2, 3 and coupling elements 4, 5, 6 attached to the strings 2, 3, which coupling elements are fixed in the locating elements 8, 9, 10, which themselves are set in the frame 7. The strings are made of gut or plastic.

In one embodiment of the invention, a racket head has a wooden frame 7 (FIG. 2), holes 20 are provided along the frame 7 and a ring shoulder 22 is disposed in each of these holes. A locating element 8 is pushed into the hole 20 until its projecting part 23 abuts on the ring shoulder 22. Furthermore, where the string 2, 3 comes out of the frame 7 in the direction toward the network 1, the locating element is provided with toothed segments 13 (FIGS. 2, 3), which have gaps 24 between them and may therefore be resiliently biased.

Figure 2:
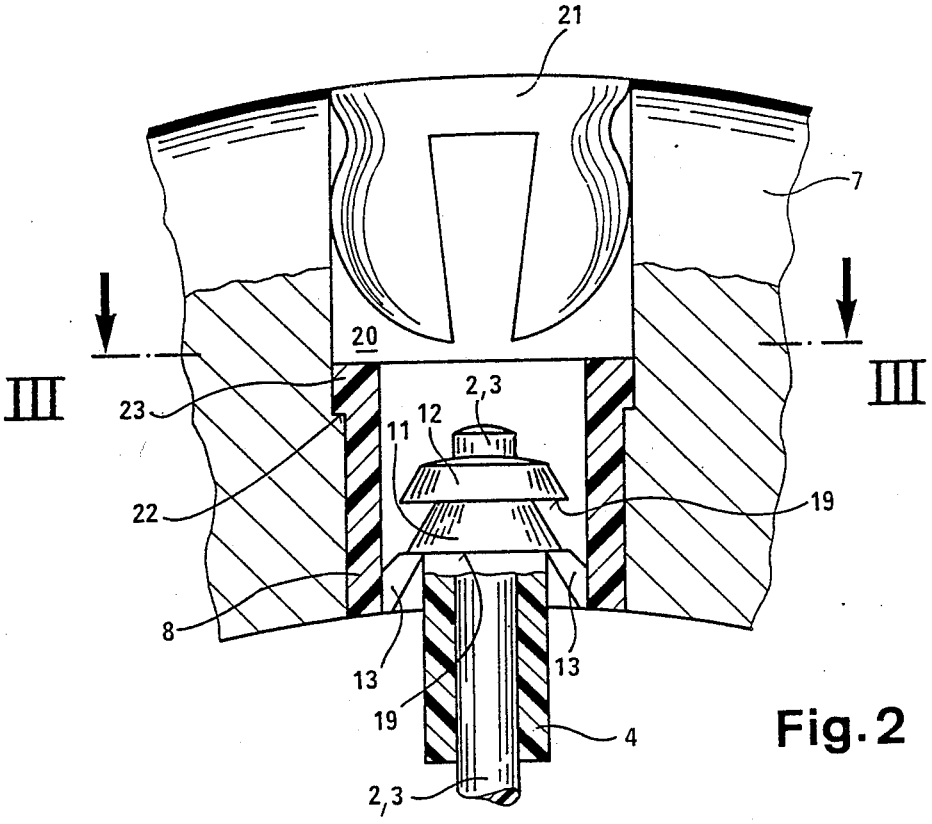
FIG. 2 shows a coupling element for fastening a string into a locating element of a wooden frame of a racket head, partially in section.
Figure 3:
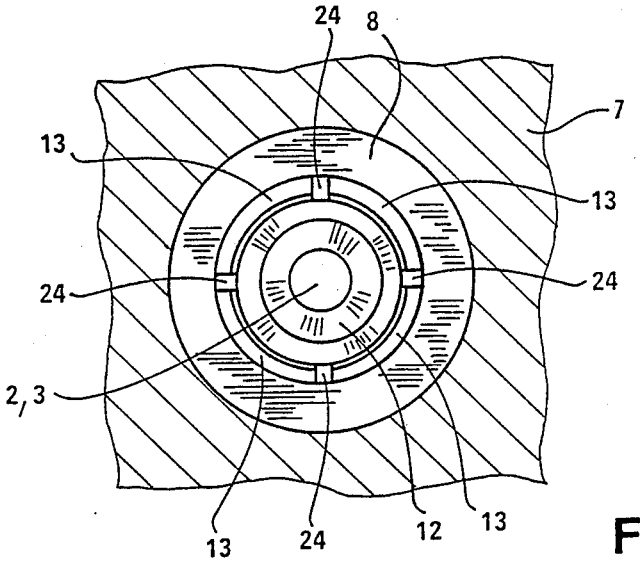
FIG. 3 is a cross-sectional view taken along the line III—III in FIG. 2.

At each end of the strings 2, 3 there is attached a coupling element 4 provided with teeth 11, 12 at its free end. To insert a coupling element 4 and thereby insert the string 2, 3, the coupling element 3 is pushed into the locating element 8. The toothed segments 13 in the locating element 8 first yield elastically. Then, when the coupling element 4 in the locating element is pushed farther into the locating element 8, they spring back behind a rear flank 19 of the tooth 12. When the coupling element 4 is pushed still farther into the locating element 8, the toothed segments 13 first yield elastically, then spring back behind the rear flank 19 of the next tooth 11 (FIGS. 2, 3). When the coupling element 4 has been pushed only slightly into the locating element 8, the toothed segments 13 will be supported between the teeth 11 and 12 on the coupling element 4. When the coupling element 4 is pushed further into the locating element 8, the toothed segments 13 will be supported on the shaft of the locating element 4.

Pushing the coupling elements 4 further or less far into the locating elements 8 serves to produce the desired initial tension of the string 2, 3 concerned.

In the embodiment shown, each hole 20 is plugged with a stopper 21 which prevents a coupling element 4 that snaps out of the string 2, 3 from darting out of the hole 20, and which gives the frame 7 a continuous surface on its outer surface.

Instead of individual stoppers 21 for the holes 20, the stoppers may also be mounted on a flexible band (not shown in the drawings), by means of which all the holes 20 can be quickly plugged, giving the outer surface of the frame 7 a uniform surface.

Figure 4:
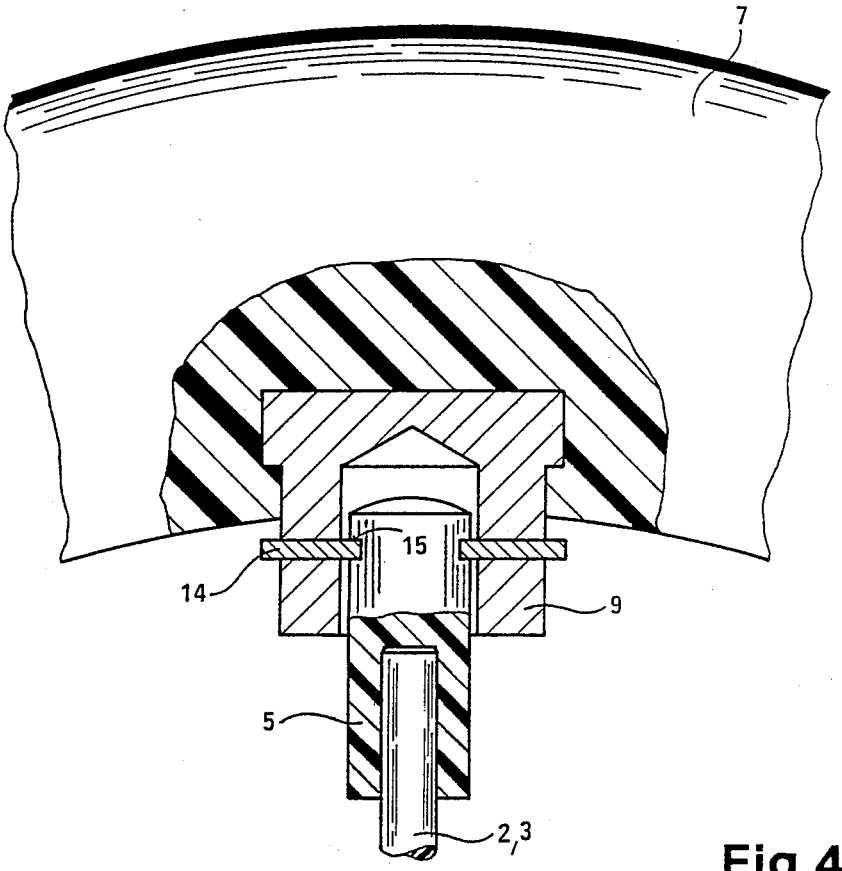
FIG. 4 shows another coupling element for fastening a string into another locating element of a plastic frame of a racket head, partially in section.

Another embodiment of the invention (FIG. 4) uses a plastic frame 7 of the racket head and the locating elements 9 are molded thereinto. The locating element 9 projects partially out of the frame 7 in the direction toward the network 1. In the area of the locating element 9 projecting from the surface of the frame 7 there is mounted a supporting ring 14, which engages a groove 15 in the coupling element 5, which is attached to the string 2, 3 concerned, so that the coupling element 5 is held in the corresponding locating element 9.

Figure 5:
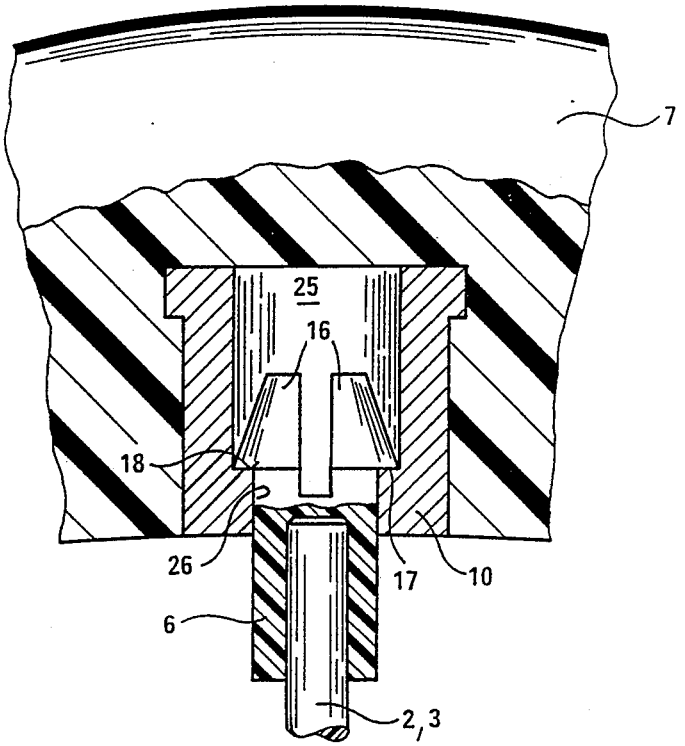
FIG. 5 shows another coupling element for fastening a string into another locating element of a plastic frame of a racket head, partially in section.

In another embodiment of the invention (FIG. 5), the frame 7 of the racket head is also made of plastic. Locating elements 10 are molded into it. These locating elements are each provided with a ring shoulder 18, which is situated at the joint between a wider hole 25 and a narrower hole 26. The coupling element 6 mounted on the particular string 2, 3 has spring elements 16, which are turned away from the string 2, 3, and these spring elements taper at their free ends. With these spring elements the coupling element 6 is pushed into the locating element 10, compressing the spring elements 16 until the shoulders 17 of the spring elements 16 snap into the inner hole 25. Upon pulling the string 2, 3, the particular shoulder 17 of the corresponding spring element 16 abuts on the ring shoulder 18 in the locating element 10, thereby holding the particular coupling element 6 in the corresponding locating element 10.

The coupling elements 4, 5, 6 may be made of metal or plastic. They are glued, bonded, or pressed together with the ends of the strings 2, 3.

The locating elements 8, 9, 10 may also be made of metal or plastic.

The coupling elements 4, 5, 6 at one end of each string may be inserted without tension into the locating element 8, 9, 10 concerned. The insertion of the coupling element 4, 5, 6 at the other end of each string 2, 3 into the opposite locating element 8, 9, 10 is possible only with the aid of a tool due to the tension in the string.

However, the tool for inserting the strings 2, 3 can have a simple construction compared to the currently known tensioning device and can be purchased by any player, so that any player can acquire such a tool.

As a result, the storage of rackets with different tensions, necessary in the past, will no longer be required. One need only store non-tensioned rackets and separate strings for each. Thus, the whole network consisting of a large number of separate strings 2, 3 with the coupling elements 4, 5, 6 attached thereto, can be kept ready for the player as a packaged unit, for example, packed in shrink film.

Similarly, each string 2, 3 can be kept ready for the player as a separate package. In this manner, in contrast to today's strings, the player has the advantage of obtaining strings 2, 3 which for a specified type of racket, with a prescribed length after insertion, will have a predetermined initial tension.

Another advantage over rackets of known construction is that, when one string breaks, all the other strings retain their initial tension without change.

The locating elements 8, 9, 10 may also be fixed in bayonet fashion in the frame 7, glued to the frame, pinned or attached thereto in some other fashion.

I claim:

1. A racket assembly including a frame extending around a generally planar head area and having a plurality of holes therein extending in the plane of the area and opening into the latter, a plurality of strings arranged in said area, and connector structure for securing the ends of the strings in respective corresponding holes, said connector structure including a string connector assemblage comprising:

a coupling element rigidly secured to one end of a said string and including a shoulder surface facing away from said one end and toward the other end of the string; and a locating element in the corresponding hole for said one end of the string and having an abutment surface facing away from said area, said string and said coupling element being adapted to be pushed into said corresponding hole together so that said surfaces become engaged, without any further manipulations, to hold the coupling element and the string in a predetermined string tensioning position relative to the racket frame.

2. A racket assembly as set forth in claim 1, wherein said connector structure includes a said string connector assemblage for each end of said string.

3. A racket assembly as set forth in claim 1, wherein said connector structure includes a said string connector assembly for each of said strings.

4. A racket assembly as set forth in claim 1, wherein said connector structure includes a said string connector assemblage for each end of each of said strings.

5. A racket as set forth in claim 1, wherein said locating element includes a resilient member carrying said abutment surface, said member and said coupling element including camming structure for causing the member to yield elastically to clear the coupling element as the latter is pushed into the hole and to spring back into a position with said surfaces in said engagement when the coupling element reaches said predetermined string tensioning position.

6. A racket as set forth in claim 1, wherein said frame includes a member projecting into said area and said corresponding hole is in said member, said locating element comprising a holding ring extending around said member and into said hole to present said abutment surface, there being a groove in said coupling element configured to receive said ring therein and presenting said shoulder surface.

7. A racket as set forth in claim 1, wherein said coupling element includes a resilient member carrying said shoulder surface, said member and the locating element including camming structure for causing the member to yield elastically to clear the locating element as the coupling element is pushed into the hole and to spring back into a position with said surfaces in said engagement when the coupling element reaches said predetermined string tensioning position.

8. A racket as set forth in claim 5 or claim 7 wherein said camming structure is presented by a conically shaped surface on said coupling element.

9. A racket as set forth in claim 1, wherein at least one of said holes extends through the frame and said racket includes a stopper for plugging said one hole.

10. A string for use in connection with the racket of claim 12, and having a said string connector assemblage at one of its ends.

11. A string as set forth in claim 10, and having a said string connector assemblage at each of its ends.

* * * * *